US006380468B1

(12) United States Patent
Shigenaga

(10) Patent No.: US 6,380,468 B1
(45) Date of Patent: Apr. 30, 2002

(54) DRUM HAVING SHELL CONSISTING OF MORE THAN ONE KIND OF VIBRATORY ELEMENT ARRANGED IN PARALLEL WITH RESPECT TO SKIN

(75) Inventor: Fumihiro Shigenaga, Shizuoka (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/672,727

(22) Filed: Sep. 28, 2000

(30) Foreign Application Priority Data

Sep. 30, 1999 (JP) ..... 11-279657

(51) Int. Cl.[7] ..... G10D 13/02
(52) U.S. Cl. ..... 84/411 R; 84/414
(58) Field of Search ..... 84/104, 411 R, 84/414

(56) References Cited

U.S. PATENT DOCUMENTS 4,060,019 A * 11/1977 Cordees ..... 84/411 R
4,060,029 A * 11/1977 Cordes ..... 84/411 R
4,522,006 A 6/1985 Plikuhn
4,833,964 A * 5/1989 Prouty ..... 84/411 R
4,939,972 A * 7/1990 Falberg ..... 84/422.4
5,301,591 A 4/1994 Greenberg
5,353,674 A * 10/1994 Volpp ..... 84/411 R
5,377,576 A 1/1995 Good et al. ..... 84/411 R
5,587,544 A * 12/1996 Fuji et al. ..... 84/411 R

FOREIGN PATENT DOCUMENTS

EP 0194834 9/1986

OTHER PUBLICATIONS

European Search Report issued Jan. 29, 2001 (received Jan. 29, 2001) in a related application (in English).

* cited by examiner

*Primary Examiner*—Robert E. Nappi
*Assistant Examiner*—Kim Lockett
(74) *Attorney, Agent, or Firm*—Dickstein Shapiro Morin & Oshinsky LLP

(57) ABSTRACT

Skins are stretched over circular apertures of a composite shell, and are fastened to the composite shell, wherein the composite shell has a monolithic woody cylindrical member and metallic bars embedded in the monolithic woody cylindrical member in such a manner as to be exposed to the end surfaces thereof so that the vibrating skins concurrently give rise to vibrations in the monolithic woody cylindrical member and the metallic bars for producing new beat sound between the beat sound produced through a woody shell and the beat sound produced through a metallic shell.

20 Claims, 4 Drawing Sheets

DRUM HAVING SHELL CONSISTING OF MORE THAN ONE KIND OF VIBRATORY ELEMENT ARRANGED IN PARALLEL WITH RESPECT TO SKIN

FIELD OF THE INVENTION

This invention relates to a percussion instrument and, more particularly, to a drum having a composite shell.

DESCRIPTION OF THE RELATED ART

Various kinds of drum such as, for example, a bass drum, a snare drum, a military drum and a floor tom are used in the rhythm section for giving the beat. The drum is usually broken down into a shell, a skin or skins and a fastening means. The shell is a tubular member, and the skin is stretched over an opening of the shell. The fastening means is provided between the shell and the skin for integrating the skin with the shell. While a tune is being played, a performer strikes the skin by sticks or a drum- beater so as to give the beat. A column of air is defined inside the shell, and serves as a vibration propagating medium.

The shell is expected to exhibit good vibration characteristics as well as the geometric stability. As described hereinbefore, the skin is stretched over the opening, and is fastened to the shell. A snare drum has a snappy stretched over the bottom opening together with the skin, and is also fastened to the shell. The skins and the snappy exert tension on the shell. Material is expanded and contracted depending upon the ambient temperature, and the expansion and the contraction is causative of the thermal stress. The shell is to maintain the geometry or the shape against the tension and the thermal stress. The dimensions of the shell are influential on the column of air, and well-tuned beat sound is generated through the stable column of air. Thus, the geometric stability is influential on the sound quality, and, accordingly, is one of the substantial properties of the shell.

The shell is to be prohibited from the self-oscillation and the self-absorption, and is designed to have vibration characteristics without self-oscillation and self-absorption. The vibration characteristics of the shell are also influential on the tone quality. Although there are various factors influential on the tone quality, the material of the shell is a non-ignoreable factor of the vibration characteristics. The shell is usually formed of wood, metal/alloy such as, for example, aluminum or fiber-reinforced synthetic resin usually referred to as FRP (Fiber-Reinforced Plastic).

The shell formed of metal or fiber-reinforced synthetic resin propagates the vibrations at relatively high speed, and high-frequency vibrations are much liable to be propagated through the metal/fiber-reinforced synthetic resin shell. The higher the pitch, the shorter the decay time. The beat sound propagated through the metal/fiber-reinforced synthetic resin shell tends to be rapidly decayed. This results in sharp bright beat sound.

On the other hand, the woody shell propagates the vibrations at relatively low speed, and low-frequency vibrations are much liable to be propagated through the woody shell. The decay time is longer than that of the metallic shell. This results in gentle beat sound.

The woody shells are the majority of the material for the shells commercially sold on the market. Drummers have deep interest and anxiety on new beat sound, and request the manufacturer to design a new drum for producing beat sound different in sound quality from the conventional beat sound.

Drum manufacturers have developed the shells for producing new beat sound. U.S. Pat. No. 5,377,576 discloses a composite shell, which consists of three tubular elements. A woody tubular element is sandwiched between two metallic tubular elements, and the three tubular elements are connected in series. The three tubular elements are assembled into the composite shell.

In detail, the woody tubular element has thin portions at both ends thereof, and the thin portions and the remaining portion form steps at the boundary therebetween. Each of the metallic tubular elements has a thin portion at one end thereof, and the thin portion and the remaining portion form a step at the boundary therebetween. The thin portions of the woody tubular element and the thin portions of the metallic tubular elements form socket-and- spigot joints. The thin portions of the metallic tubular elements are inserted into the thin portions of the woody tubular element, and are assembled with the woody tubular element by means of the socket-and- spigot joints. The metallic tubular members are formed with projections, respectively, and through- holes are respectively formed in the projections. The woody tubular member is also formed with a projection, and threaded holes are formed. Bolts pass through the through- holes, respectively, and are screwed into the threaded holes. The bolts press the metallic tubular elements to the woody tubular element, and the metallic tubular elements are fixed to the woody tubular element. Thus, the metallic tubular elements are connected in series to the woody tubular element, and the metallic tubular elements and the woody tubular element form in combination the composite shell. Skins are stretched over the openings of the composite shell, and are fastened thereto.

When a drummer strikes the skin, the skin vibrates, and the vibrations are firstly propagated from the vibrating skin to the metallic tubular element. The metallic tubular element vibrates, and propagates the vibrations to the woody tubular element. Although the prior art drum disclosed in the U.S. Patent is designed to generate new beat sound between the beat sound produced through the metallic shell and the beat sound produced through the woody shell, the beat sound produced through the prior art composite shell is much closer to that of the metallic shell.

SUMMARY OF THE INVENTION

It is therefore an important object of the present invention to provide a drum, which produces new beat sound between those produced through monolithic shells formed of materials different in vibration characteristics.

It is also an important object of the present invention to provide a drum, a composite shell of which is large in mechanical strength.

The present inventor contemplated the problems inherent in the prior art drum, and noticed that the vibrations were propagated from the skin through the metallic tubular element to the woody tubular element. In other words, the vibrations were to be propagated through the boundary between the metal tubular element and the woody tubular element. This meant that the boundary conditions had strong influence on the magnitude of the vibrations propagated to the woody tubular element, and the vibrations lost non-ignoreable amount of vibrational energy at the boundary. In this situation, the vibrations of the metallic tubular element dominated the sound quality of the beat sound. The present inventor concluded that the vibrations were to be evenly propagated from the skin to the shell components.

To accomplish the object, the present invention proposes to connect more than one shell components to an origin of vibrations in parallel.

In accordance with one aspect of the present invention, there is provided a drum comprising a composite shell including a first component member formed of a first material and a second component formed of a second material different in vibration propagating property from the first material and assembled with the first component so as to be exposed to an end surface of the first component defining an aperture, at least one skin stretched over the aperture and held in contact with the end surface for propagating vibrations to the first component and the second component and a fastening means for fixing the at least one skin to the composite shell.

BRIEF DESCRIPTION OF THE DRAWINGS

The features and advantages of the drum will be more clearly understood from the following description taken in conjunction with the accompanying drawings in which.

DESCRIPTION OF THE PREFERRED EMBODIMENTS

First Embodiment

Figure 1:
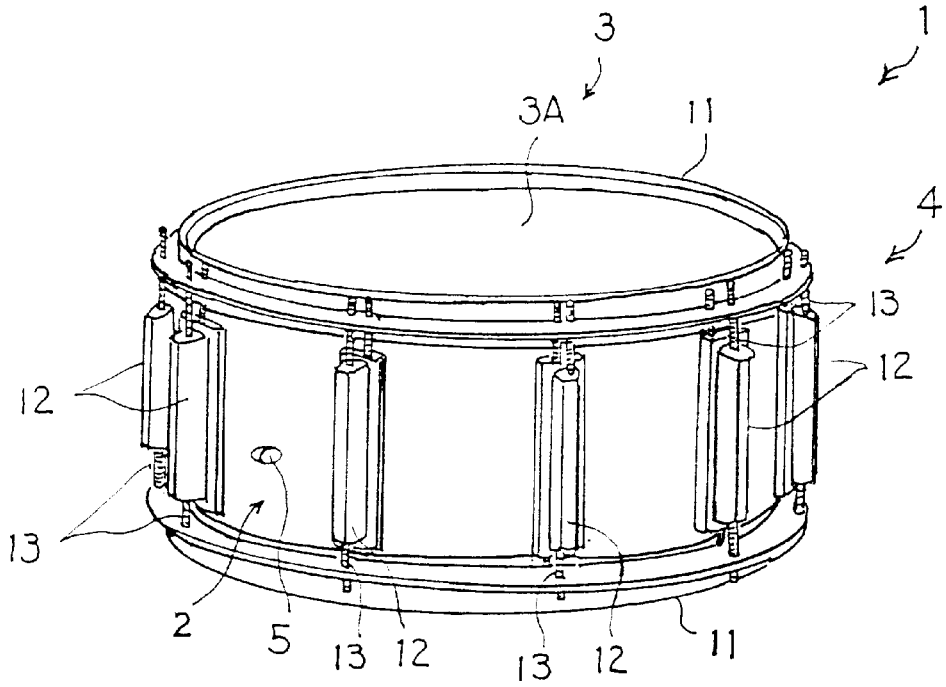
FIG. 1 is a perspective view showing the appearance of a drum according to the present invention.
Figure 2:
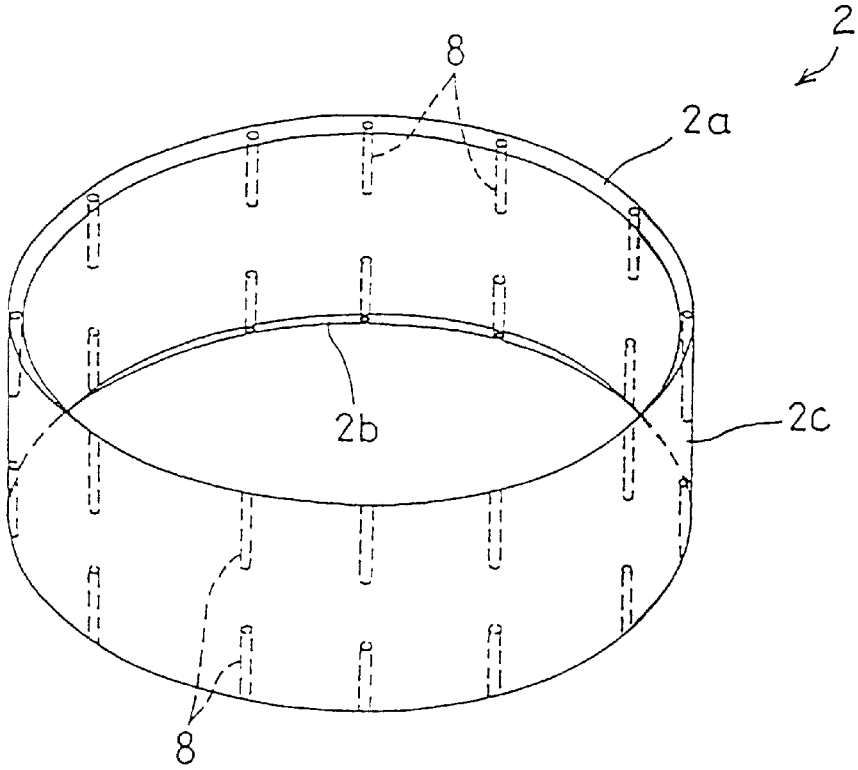
FIG. 2 is a perspective view showing a composite shell incorporated in the drum.

Referring to FIGS. 1 and 2 of the drawings, reference numeral 1 designates a snare drum embodying the present invention. The snare drum 1 largely comprises a composite shell 2, a pair of skins 3 and a fastening means 4. The composite shell 2 has a tubular shape, and a vent hole 5 is formed in the composite shell 2. The inner space of the composite shell is connected through the vent hole 5 to the outside thereof. Circular apertures 2*a*/2*b* are defined at both ends of the composite shell 2, and skins 3A/3B are stretched over the circular apertures 2*a*/2*b*, respectively. The skins 3A/3B are fixed to the composite shell 2 by means of the fastening means 4.

Figure 3:
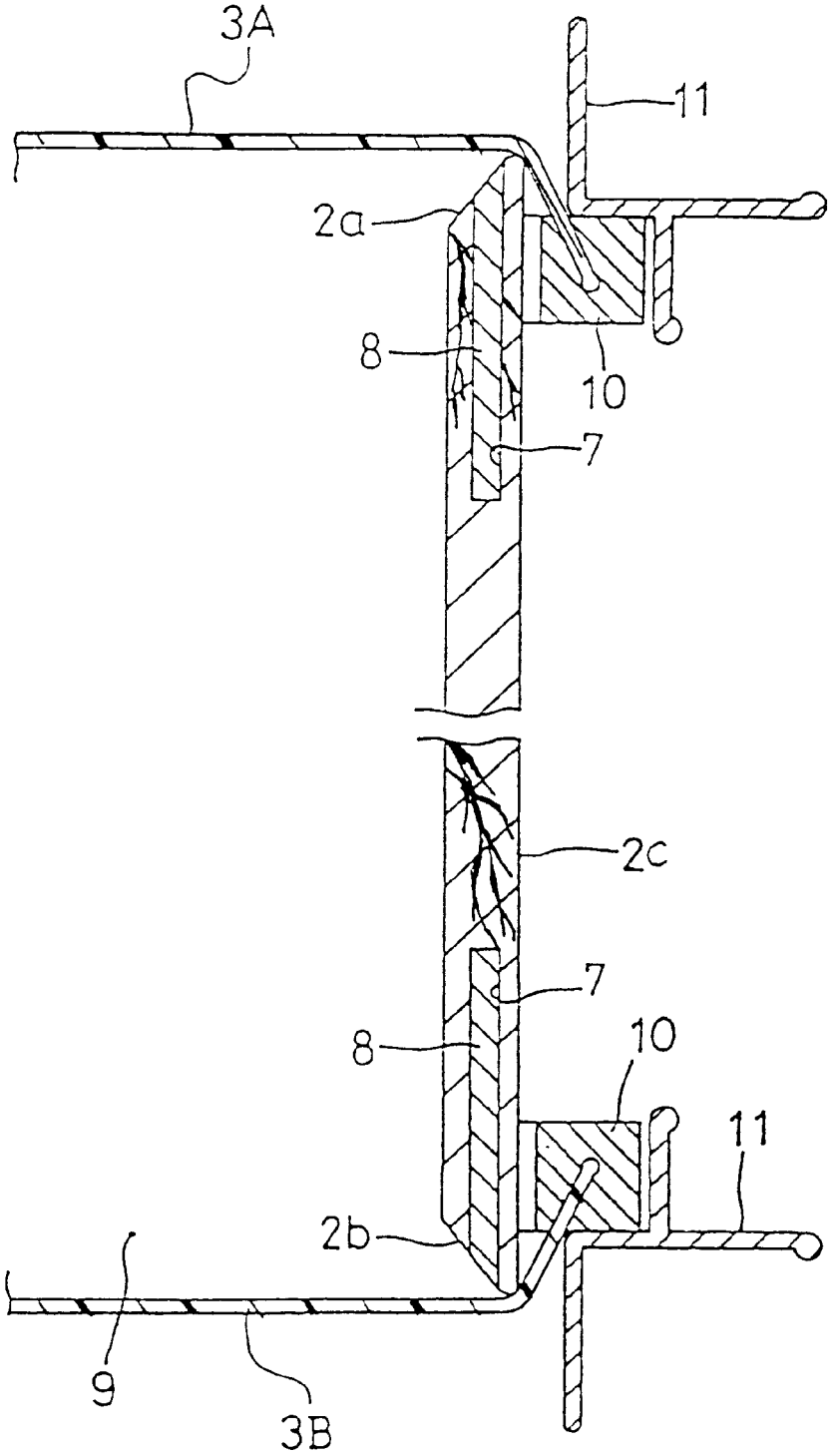
FIG. 3 is a cross sectional view showing the structure of the drum.

The composite shell 2 is fabricated from two kinds of components 2*c*/8, i.e., a woody cylindrical member 2*c* and a plurality of metallic bars 8. The woody cylindrical member 2*c* is sharpened at both ends thereof. For this reason, there are inclined end surfaces between the inner surface and the outer surface of the woody cylindrical member 2*c*. Holes are formed in the woody cylindrical member 2*c*, and the holes are selectively open to the inclined end surfaces of the woody cylindrical member 2*c*. The metallic bars 8 are inserted into the holes, and are snugly received. Thus, the metallic bars 8 are embedded in the woody cylindrical member 2*c*, and are exposed to the inclined end surfaces. In this instance, half of the metallic bars 8 are exposed to the inclined end surface defining the circular aperture 2*a*, and the other half of the metallic bars 8 are exposed to the inclined end surface defining the other circular aperture 2*b*. The metallic bars 8 exposed to one of the inclined end surfaces are respectively paired with the remaining metallic bars 8, and the pairs of metallic bars 8 are on virtual lines substantially parallel to the center line of the composite shell 2 as shown in FIG. 3. The skins 3A/3B or drum heads are held in contact with the inclined end surfaces, respectively, and are fixed to the composite shell 2 by means of the fastening means 4. A column of air 9 is defined by the woody cylindrical member 2*c* and the skins 3A/3B.

When a drummer strikes the skin 3A, vibrations takes place in the skin 3A, and are propagated from the skin 3A to the inclined end surface defining the circular aperture 2*a*. Thus, the vibrating skin 3A gives rise to vibrations in the metallic bars 8 as well as the woody cylindrical member 2*c*. The vibrations are propagated from the vibrating skin 3A through the column of air 9 to the other skin 3B. The sound quality is dominated by neither first member 2*c* nor second member 8, because the vibrations are concurrently propagated from the vibrating skins 3A/3B to the metallic bars 8 and the woody cylindrical member 2*c*. This means that the beat sound is a compromise between the beat sound produced through a woody shell and the beat sound produced through a metallic shell.

The woody cylindrical member 2*c* is a monolithic structure, and any socket-and- spigot join is not required for the composite shell 2. The monolithic cylindrical member 2*c* is larger in mechanical strength than the woody tubular element connected to the metallic tubular elements by means of the socket-and- spigot joints. Moreover, the metallic bars 8 reinforce the woody cylindrical member 2*c*. Even if large external force is exerted on the composite shell 2, the composite shell 2 withstands the large external force, and is hardly broken.

The woody cylindrical member 2*c* is formed as follows. Maple, birch and beech have fairly large hardness and good acoustic properties, and are appropriate for the woody cylindrical member 2*c*. A rotary lathe is prepared. A log of maple tree/birch tree/beech tree is placed on the rotary lathe. The rotary lathe peels the log. Then, sheets of maple wood/birch wood/beech wood are obtained from the log. The woody sheets are thin and constant in thickness. The woody sheets are laminated, and are bonded to one another. The laminated wood plate is rounded into a cylindrical shape. A side portion of the laminated wood plate is secured to the other side portion, and both end portions are obliquely cut off so as to form the inclined end surfaces. The inclined end surfaces make the contact between the skins 3A/3B and the composite shell 2 clear. Finally, the holes are formed in both end portions of the woody cylindrical member 2*c*. The holes are equally spaced along the periphery of the composite shell 2 at regular intervals. Five to twenty holes are formed in each end portion of the woody cylindrical member 2*c*.

The metallic bars 8 are, by way of example, formed of iron, brass, copper or aluminum. The metal bars 8 are 1–6 millimeters in diameter. The length of the metallic bars 8 is variable together with the volume of the composite shell 2. Standard metallic bars 8 are of the order of 10 millimeters long. The metallic bars 8 are adhered to the woody cylindrical member 2*c* by means of adhesive compound. In this instance, the metallic bars 8 are formed of brass, and are 5 millimeters in diameter and 45 millimeters in length. Twenty metallic bars are embedded in each end portion of the woody cylindrical member 2*c*, and, accordingly, forty metallic bars 8 are arranged in both end portions of the woody cylindrical member 2*c*.

The skins 3A/3B are formed of natural leather or synthetic resin such as, for example, polyester resin or polycarbonate resin. Constant tension is exerted on the skin 3A/3B, and the skin 3A/3B is stretched over the circular opening 2*a*/2*b*. The skins 3A/3B are secured to the composite shell 2, and are held in contact with the inclined end surfaces. Thus, the circular apertures 2*a*/2*b* are closed with the skins 3A/3B. The air of column 9 is confined inside of the composite shell 2, and vibrations are propagated from the vibrating skin 3A through the column of air 9 to the other skin 3B.

The fastening means 4 includes hoops 10, rims 11, lugs 12 and bolts 13. As will be best seen in FIG. 3, the skins 3A/3B are respectively anchored at the hoops 10, and the end portions of the composite shell 2 are inserted into the hoops 10. The rims 11 are attached to the hoops 10, respectively, and through-holes are formed in the rims 11 at regular intervals. The lugs 12 are fixed to the woody cylindrical member 2*c* at the regular intervals, and threaded holes are formed on both end portions of each lug 12. The bolts pass through the through- holes, and are screwed into the threaded holes formed in the lugs 12. The rims 11 are forced to advance toward the lugs 12, and press the hoops 10. The hoops 10 stretch the skins 3A/3B, and tension is exerted to the skins 3A/3B. The tension is regulable by turning the bolts 13. Thus, the fastening means 4 fixes the skins 3A/3B to the composite shell 2, and exerts tension on the skins 3A/3B.

Assuming now that a drummer strikes the skin 3A with a stick, the skin 3A vibrates, and the vibrations are propagated through the air of column 9 and the composite shell 2 to the other skin 3B. The vibrating column of air 9 and the vibrating composite shell 2 give rise to vibrations in the skin 3B. The vibrations are propagated from the skin 3B through the column of air 9 and the composite shell 2 to the skin 3A, again. Thus, the propagation of vibrations are repeated between the skins 3A and 3B, and beat sound is radiated from the drum 1. The woody cylindrical member 2*c* is the monolithic structure, and forms the inclined end surfaces where the skins 3A/3B are held in contact. For this reason, the vibrations are directly propagated from the skin 3A/3B to the woody cylindrical member 2*c* and vice versa without serious energy loss. The metallic bars 8 are exposed to the inclined end surfaces, and the vibrations the skins 3A/3B give rise to the vibrations in both of the woody cylindrical member 2*c* and the metallic bars 8. This results in new sound quality between the sound quality produced through the woody shell and the sound quality produced through the metallic shell.

The present inventor investigated the quality of the beat sound. The present inventor prepared the drum shown in FIG. 3 and a comparative drum with a woody shell. The present inventor measured the vibrations of the woody cylindrical member 2*c* as well as the vibrations of the metallic bars 8. The present inventor further measured the vibrations of the woody shell of the comparative drum.

The present inventor firstly confirmed that the vibrations were concurrently transferred from the skin 3A/3B to the woody cylindrical member 2*c* and the metallic bars 8. The propagation speed in the metallic bars 8 was larger than that in the woody cylindrical bars 8, and the vibrations were propagated through the composite shell 2 between the skins 3A and 3B at a relatively high propagation speed. On the other hand, the propagation speed in the woody shell was small, and the vibrations were propagated between the skins through the woody shell at a relatively small propagation speed. The difference in propagation sheep resulted in sound quality. The present inventor confirmed that the beat sound produced through the drum 1 was different from the beat sound produced through the prior art drum with a woody shell as well as the beat sound produced through the prior art drum with a metallic shell. Thus, the drum 1 according to the present invention produced the new beat sound.

The present inventor further investigated influences of the metallic bars 8 on the sound quality. The present inventor prepared the composite shells 2, which were different in the number of metallic bars and the dimensions of metallic bars from one another.

The present inventors selected composite shells, the metallic bars of which were equal in number but different in dimensions. The present inventor compared the sound quality produced through those composite shells with one another. The present inventor confirmed that the metallic bars accelerated the propagation of vibrations between the skins. The longer the metallic bars, the larger the propagation speed. Accordingly, when the beat sound was produced through the composite shell with long metallic bars, the sound quality was closer to that of the metallic shell than the sound quality produced through the composite shell with short metallic bars.

Subsequently, the present inventor selected another set of composite shells, the metallic bars of which were equal in dimensions but different in number. The more the metallic bars, the larger the propagation speed. When the beat sound was produced through the composite shell with a large number of metallic bars, the sound quality was closer to that of the metallic shell than the sound quality produced through a composite shell with a small number of metallic bars.

The present invention further investigated influences of the socket-andspigot joint. The present inventor measured the vibrational energy. The present inventor confirmed that the energy loss was much smaller in the composite shell 2 than the energy loss in the prior art composite shell with the socket-and-spigot joints. Accordingly, the drum according to the present invention generated the beat sound much larger in loudness than the beat sound of the prior art drum.

Second Embodiment

Figure 4:
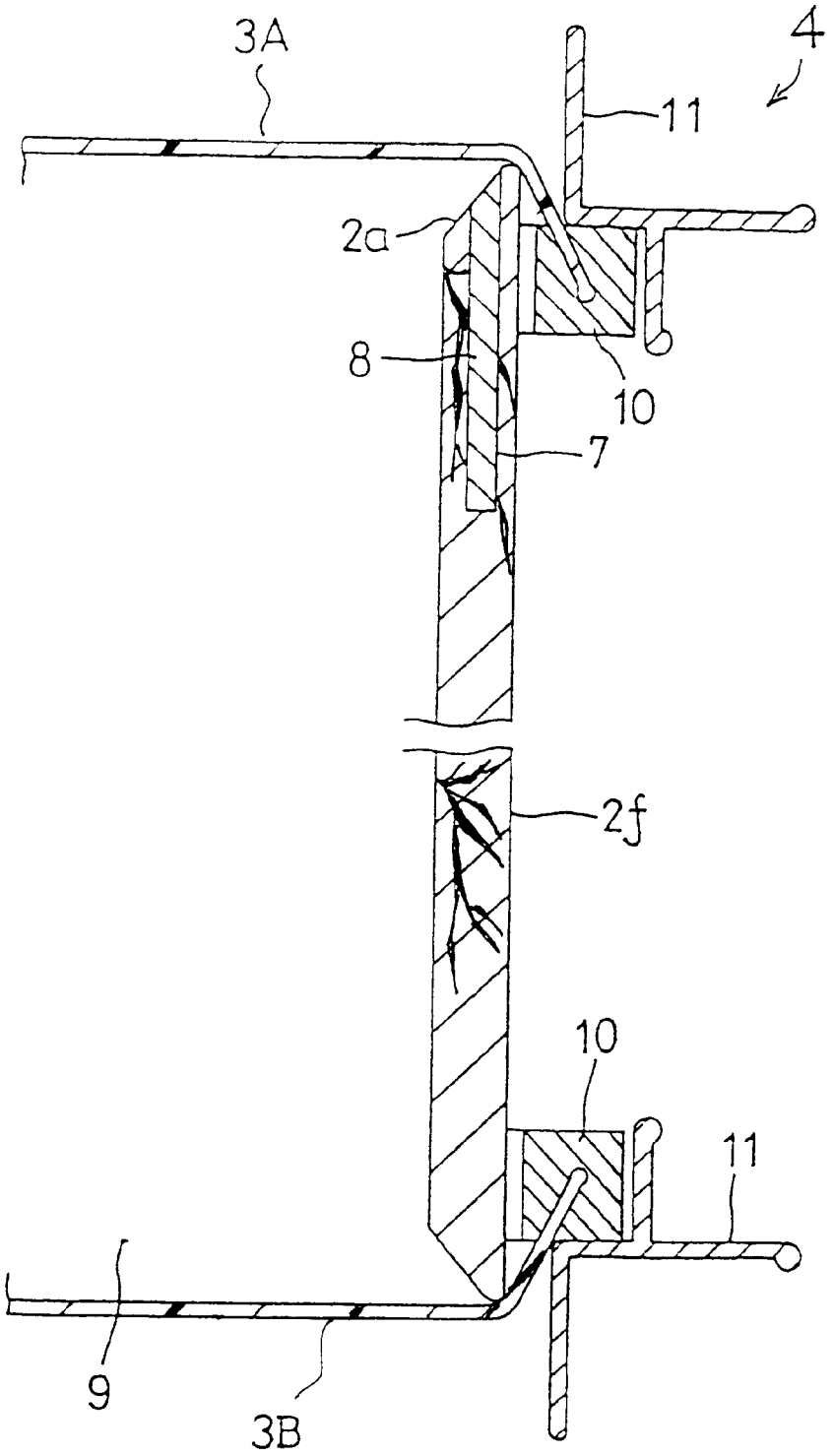
FIG. 4 is a cross sectional view showing the structure of another drum according to the present invention.

Turning to FIG. 4 of the drawings, another drum embodying the present invention largely comprises a composite shell, skins 3A/3B and a fastening means 4. The skins 3A/3B and the fastening means 4 are similar to those of the first embodiment, and no further description is incorporated hereinbelow.

The composite shell is broken down into a woody cylindrical member 2*f* and metallic bars 8. The woody cylindrical member 2*f* also has inclined end surfaces 2*a*/2*b*. Although the holes are open to both inclined end surfaces 2*a*/2*b* in the woody cylindrical member 2*c*, all the holes are open to the inclined end surface 2*a* of the woody cylindrical member 2*f*. The metallic bars 8 modify the quality of beat sound produced through the composite shell of the second embodiment, and the sound quality is a contaminant between the sound quality produced through the woody shell and the sound quality produced through the metallic shell.

The present inventor investigated the influences of the metallic bars, and confirmed that the sound quality was modifiable depending upon the dimensions and the number of the metallic bars as similar to the first embodiment.

Third Embodiment

Figure 5:
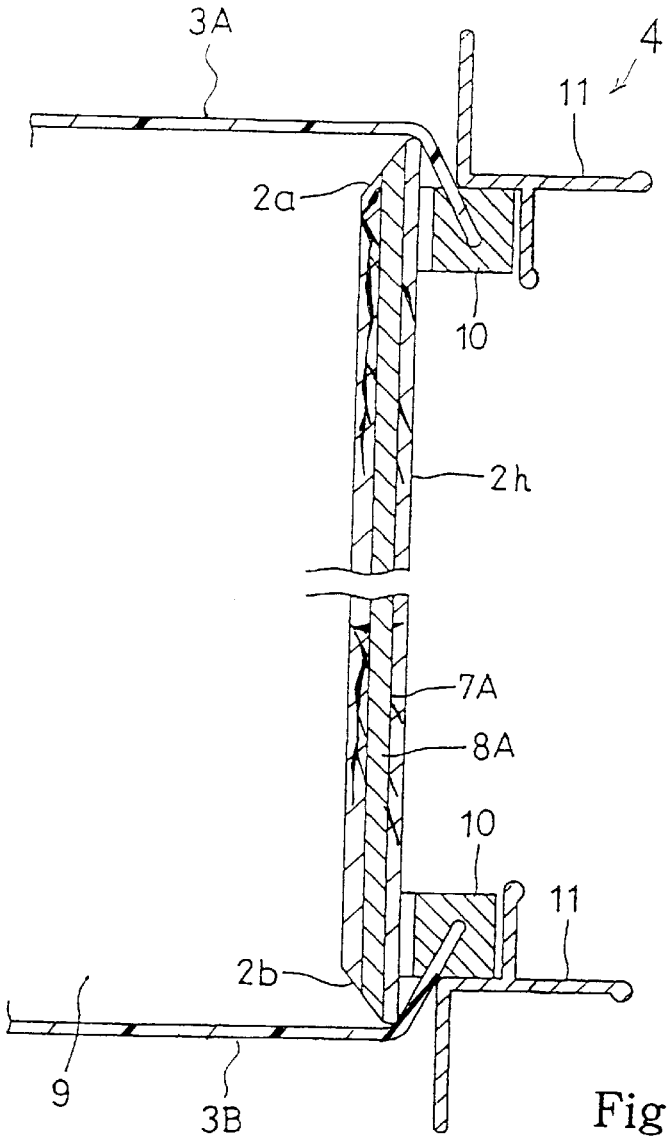
FIG. 5 is a cross sectional view showing an end surface of a composite shell incorporated in yet another drum according to the present invention.

Turning to FIG. 5 of the drawings, yet another drum embodying the present invention also largely comprises a composite shell, skins 3A/3B and a fastening means 4. The skins 3A/3B and the fastening means 4 are similar to those of the first embodiment, and no further description is incorporated hereinbelow.

The composite shell is broken down into a woody cylindrical member 2*h* and metallic bars 8. The woody cylindrical member 2*h* also has inclined end surfaces 2*a*/2*b*. Although the holes of each pair are separated from each other in the woody cylindrical member 2*c*, the holes open to the inclined end surface 2*a* are respectively connected to the associated holes in the woody cylindrical member 2*h*. In other words, all the through holes are open to both inclined end surfaces 2*a*/2*b* in the woody cylindrical member 2*h*. Accordingly, the metallic bars 8 are as long as the woody cylindrical member 2*h*, and are open to both inclined end surfaces 2*a*/2*b*.

The metallic bars 8 modify the quality of beat sound produced through the composite shell of the third embodiment, and the sound quality is a contaminant between the sound quality produced through the woody shell and the sound quality produced through the metallic shell.

The present inventor investigated the influences of the metallic bars, and confirmed that the sound quality was modifiable depending upon the dimensions and the number of the metallic bars as similar to the first embodiment.

Fourth Embodiment

Figure 6:
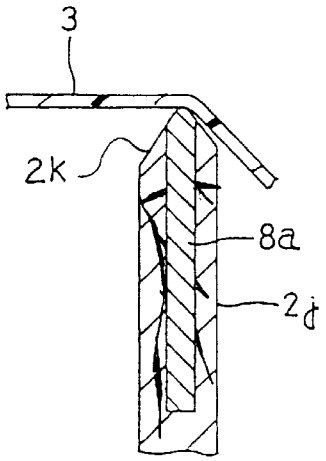
FIG. 6 is a cross sectional view showing an end portion of a composite shell incorporated in still another drum according to the present invention.

Turning to FIG. 6 of the drawings, still another drum embodying the present invention also largely comprises a composite shell, skins 3A and a fastening means. The skins 3 and the fastening means are similar to those of the first embodiment, and no further description is incorporated hereinbelow.

The composite shell is broken down into a woody cylindrical member 2*j* and metallic bars 8*a*. The woody cylindrical member 2*j* has ridge end surfaces 2*k*, and the center axes of the holes are on the ridge lines of the end surfaces 2*k*. The metallic bar 8*a* has a ridge end, and the ridge end is same in shape as the ridge end surface of the woody cylindrical member 2*j*. When the metallic bars 8a are inserted into the holes, the ridge ends are coplanar with the ridge end surfaces, and the metallic bars 8a form parts of the ridge lines of the composite shell. When the skins 3 are stretched and fastened to the composite shell, the skins 3 are pressed against the ridge lines, respectively, and vibrations are directly propagated to the metallic bars 8a as well as the woody cylindrical member 2*j*.

The present inventor also investigated the influences of the metallic bars 8*a* on the sound quality, and confirmed that the sound quality was modifiable with the dimensions and the number of the metallic bars 8*a*.

As will be appreciated from the foregoing description, the vibrations are propagated from the skin to the metallic bars and the woody cylindrical member substantially in parallel. The vibrating skin concurrently gives rise to vibrations in the metallic bars as well as in the woody cylindrical member, and the sound quality is never dominated by neither metallic bars nor the woody cylindrical member. This results in new beat sound between the beat sound produced through the woody shell and the beat sound produced through the metallic shell.

Moreover, the woody cylindrical member has a monolithic structure, and does not contain any joint. For this reason, the vibrations are propagated through the woody cylindrical member without serious energy loss, and a drummer generates loud beat sound with the drum according to the present invention.

Finally, the metallic bars are embedded in the woody cylindrical member, and, accordingly, reinforce the woody cylindrical member. This results in that the composite shell is not damaged under the usual conditions.

Although particular embodiments of the present invention have been shown and described, it will be apparent to those skilled in the art that various changes and modifications may be made without departing from the spirit and scope of the present invention.

For example, the present invention is applicable to any kind of drum such as, for example, a bass drum, tom-toms, a side drum, tenor drum and a military drum.

A snappy may be stretched over a skin. Only one skin may be stretched over one of the apertures of the composite drum.

The metallic bars may be replaced with metallic plates. In this instance, the metallic plates may be inserted into slits formed in a woody cylindrical member, and are exposed to the end surfaces of the woody cylindrical member.

The metallic bars may be formed of another kind of alloy or metal. The metallic bars may be replaced with bars formed of fiber- reinforced synthetic resin.

A composite shell according to the present invention may further include a third component different in vibration characteristics from the cylindrical member and the metallic bars.

Although wood, metal and fiber- reinforced synthetic resin are popular, other material is available for the composite shell. Examples of the other material is, by way of example, bamboo.

What is claimed is:

1. A drum comprising a composite shell having spaced opposed end surfaces, said composite shell including a first component member formed of a first material and a second component formed of a second material different in vibration propagating property from said first material, assembled with said first component in such a manner that an end surface of said second component is coplanar with one of said opposing end surfaces of said first component defining an aperture, said second component extending from said one end surface toward the other of said end surfaces and spaced from said another end surface, at least one skin stretched over said aperture and held in contact with said end surface for propagating vibrations to said first component and said second component, and a fastening means for fixing said at least one skin to said composite shell.

2. The drum as set forth in claim 1, in which said first component is a cylindrical member having said end surface, and said second component is a plurality of bars assembled with said cylindrical member.

3. The drum as set forth in claim 2, in which said cylindrical member is formed with a plurality of holes open to said end surface, and said plurality of bars are snugly received in said plurality of holes, respectively.

4. The drum as set forth in claim 3, in which said plurality of bars are bonded to inner surfaces of said cylindrical member defining said holes.

5. The drum as set forth in claim 2, in which said cylindrical member and said plurality of bars are respectively formed of wood and metal.

6. The drum as set forth in claim 1, in which said first member further has another end surface defining another aperture connected to said aperture through a hollow space, and another skin is stretched over said another aperture and fixed to said first member by means of said fastening means.

7. The drum as set forth in claim 6, in which said first member and said second member are a cylindrical member and a plurality of bars, respectively, and said cylindrical member has said end surface and said another end surface at both ends thereof.

8. The drum as set forth in claim 7, in which said cylindrical member is formed with a first group of holes open to said end surface, and said plurality of bars are snugly received in said first group of holes.

9. The drum as set forth in claim 8, in which said end surface is inclined toward the inside of said cylindrical member so that said skin is held in contact with an outer peripheral ridge between an outer side surface of said cylindrical member and said end surface.

10. The drum as set forth in claim 8, in which said end surface has a ridge line so as to incline an outer sub-surface toward the outside of said cylindrical member and an inner sub-surface toward the inside of said cylindrical member, and said holes of said first group are open to said ridge line at intervals so that said skin is held in contact with both of said cylindrical member and said plurality of bars.

11. The drum as set forth in claim 7, in which said first group of holes are further open to said another end surface so that said plurality of bars are exposed to both of said end surface and said another end surface.

12. The drum as set forth in claim 11, in which said end surface and said another end surface are inclined toward the inside of said cylindrical member so that said skin and said another skin are respectively held in contact with an outer peripheral ridge between an outer side surface and said end surface and another outer peripheral ridge between said outer side surface and said another end surface.

13. The drum as set forth in claim 8, in which said cylindrical member is further formed with a second group of holes open to said another end surface, and said plurality of bars are selectively received in said first group of holes and said second group of holes.

14. The drum as set forth in claim 13, in which said holes of said first group are respectively paired with said holes of said second group, and the pairs of holes respectively extend on virtual lines substantially in parallel to a center line of said cylindrical member.

15. The drum as set forth in claim 13, in which said holes of said first group and said holes of said second group extend on first virtual lines substantially in parallel to a center line of said cylindrical member and second virtual lines substantially in parallel to said center line, and said first virtual lines are offset from said second virtual lines.

16. The drum as set forth in claim 1, in which said first material has a relatively high propagation speed and a relatively long decay time, and said second material has a relatively low propagation speed and a relatively short decay time.

17. The drum as set forth in claim 16, in which said first material and said second material are wood and metal, respectively.

18. The drum as set forth in claim 17, in which said wood is selected from the group consisting of maple, birch and beech, and said metal is selected from the group consisting of iron, brass, copper and aluminum.

19. A drum comprising a composite shell including a monolithic woody cylindrical member formed with a first group of holes open to a first inclined end surface and a second group of holes open to a second inclined end surface and metallic bars received in said holes of said first and second groups so as to be embedded in said monolithic woody cylindrical member, said monolithic woody cylindrical member and said metallic bars forming a resonator, a first skin stretched over a first circular aperture defined by said first inclined end surface and held in contact with said first inclined surface, a second skin stretched over a second circular aperture defined by said second inclined end surface and held in contact with said second inclined surface, and a fastening means fixing said first skin and said second skin to said composite shell and exerting tension to said first skin and said second skin.

20. The drum as set forth in claim 19, in which at least said first inclined end surface has a ridge line splitting said first inclined end surface into a first sub-surface directing toward the outside of said monolithic woody cylindrical member and a second sub-surface directing toward the inside of said monolithic woody cylindrical member, and said metallic bars are exposed to said ridge line so that said first skin is held in contact with both of said monolithic woody cylindrical member and said metallic bars.

* * * * *